US008701582B2

(12) United States Patent
Schmidt et al.

(10) Patent No.: US 8,701,582 B2
(45) Date of Patent: Apr. 22, 2014

(54) FLOATING DOCK SYSTEM

(75) Inventors: Clinton M. Schmidt, Kawkawlin, MI (US); Daniel G. Darling, Bay City, MI (US); Gary D. Parsons, Midland, MI (US); Jeffrey M. Alcott, Midland, MI (US)

(73) Assignee: Dow Global Technologies LLC, Midland, MI (US)

( * ) Notice: Subject to any disclaimer, the term of this patent is extended or adjusted under 35 U.S.C. 154(b) by 54 days.

(21) Appl. No.: 13/542,330

(22) Filed: Jul. 5, 2012

(65) Prior Publication Data

US 2013/0019791 A1 Jan. 24, 2013

Related U.S. Application Data

(60) Provisional application No. 61/510,099, filed on Jul. 21, 2011.

(51) Int. Cl.
*B63B 35/44* (2006.01)

(52) U.S. Cl.
USPC ..... 114/264; 114/267

(58) Field of Classification Search
USPC ..... 114/263, 264, 266, 267; 405/212, 215, 405/218, 219
See application file for complete search history.

(56) References Cited

U.S. PATENT DOCUMENTS

| | | | | |
|---|---|---|---|---|
| 5,081,946 | A * | 1/1992 | Nannig et al. | 114/264 |
| 5,133,276 | A * | 7/1992 | Alesi et al. | 114/263 |
| 6,450,737 | B1 | 9/2002 | Ryland et al. | |
| 7,883,294 | B1 | 2/2011 | Licina | |
| 8,528,494 | B2 * | 9/2013 | Moody | 114/263 |
| 2008/0101871 | A1 | 5/2008 | Wilcox | |
| 2011/0044765 | A1 | 2/2011 | Johanneck et al. | |

FOREIGN PATENT DOCUMENTS

| | | |
|---|---|---|
| KR | 984008 | 9/2010 |
| KR | 2010130254 | 12/2010 |

* cited by examiner

*Primary Examiner* — Lars A Olson
(74) *Attorney, Agent, or Firm* — Steven W. Mork

(57) ABSTRACT

A floating dock system contains a polymeric foam core, a structural collar, attachment means connected to the structural collar and a protective coating adhering to and completely covering the polymer foam core and structural collar and is free of decking or plates that are independent of the structural collar between the top surface of the polymeric foam core and the protective coating.

9 Claims, 1 Drawing Sheet

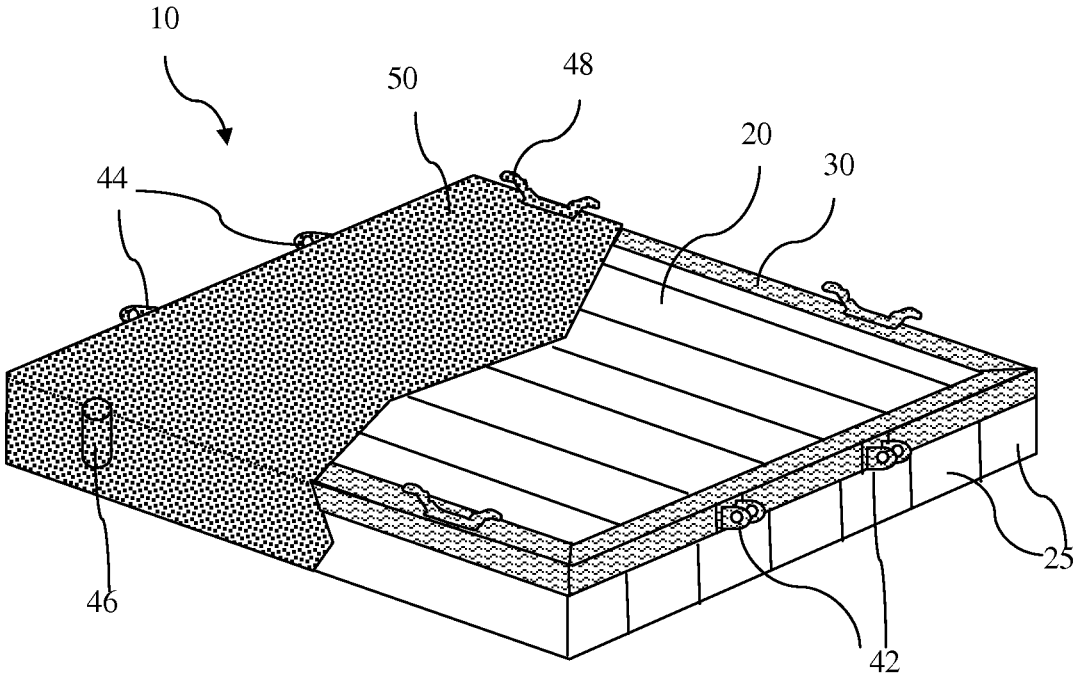
10
50
48
20
30
44
46
25
42

FLOATING DOCK SYSTEM

BACKGROUND OF THE INVENTION

1. Field of the Invention

The present invention relates to a floating dock system suitable for use in marine environments.

2. Description of Related Art

A durable, light-weight dock that is structurally sound is a desire of boating enthusiasts as well as others who wish to access a body of water from its shores. Polymeric foam is buoyant and lightweight and as such is an attractive component for docks. A common practice for assembling docks is to use polymeric foam as a floatation means that supports a metal or wooden foundational frame with wood or composite decking attached to the foundational frame and extending over the polymeric foam. In such a structure, the frame and decking form the visible deck structure on which one walks while the foam is merely a buoyancy means underneath the decking to keep it afloat. The frame further provides a firm location for affixing attachment means such as footings, cleats, dock section connectors, utility poles and the like. Such assemblies are heavy and therefore cumbersome to install and remove each season. Moreover, steel, wood and wood composites are susceptible to degradation and corrosion from environmental exposure over time. Hence, it is desirable to eliminate the foundational framing and decking from the dock structure. There are dock components that do not require the extensive frame and decking of conventional docks.

EZ Docks Unlimited, LLC offers hollow blow-molded or roto-molded polyethylene composition dock sections. The dock sections are light weight and do not require use of a decking material over them. However, because they are hollow they are susceptible to puncturing and filling with water. The molded plastic shapes further require use of specially designed attachment means for connecting dock sections together or for attaching boats or utility structures to the dock sections.

Korean patent KR984008 discloses a dock section comprising an expanded foam core with reinforcing plates taped into place on the top of the foam and then the foam, tape and plates are all coated with a polyurea coating. The reinforcing plates serve a similar purpose as decking material, by protecting the top surface of the foam core.

Korean patent application KR2010130254 discloses another polymeric foam dock sections comprising a foam core coated with at protective coating. Rather complex connecting means are included in the dock section of KR201030254. The connecting means extend through a hollow tube and extend all the way through the foam and protective coating from one side of the dock section to an opposing side. The connecting means have multiple assembled pieces including a spring loaded mechanism within the foam core. The dock section further preferably has a support plate protecting the top surface of the foam.

U.S. Pat. No. 5,081,946 discloses yet another floating dock section that comprises a foam core coated with a protective coating. A plate or decking resides between the foam core and outer protective coating along the top of the dock section with cleats and sidewall members extending therefrom. The floating dock section comprises a large number of components in addition to the foam core, protective coating, plate or decking, cleats and sidewall members including corner pieces and a plurality of eyebolts and nuts. The many pieces of this dock section make its manufacture time consuming and complex. Moreover, the required plate or decking adds undesirable weight to the dock section.

It is desirable to advance the art of light-weight docks by providing a simple dock section that comprises a foam core so it is unaffected by accidental punctures and that does not require a protective plate or decking over the top surface of the foam core. It is further desirable to provide such a dock section that has incorporated common attachment means available in the industry that are affixed to the dock section instead of requiring specially designed attachment means. Moreover, it is desirable to provide such attachment means so that they do not have to bore through the foam core or comprise multiple parts to assemble.

BRIEF SUMMARY OF THE INVENTION

The present invention advances the art of light-weight docks by solving problems needed to achieve such a dock with the aforementioned characteristics. The present invention provides a durable, light-weight dock comprising a foam core that is free from a plate or decking material covering the surface of the foam core between the foam core and the protective coating. The present invention includes attachments means that can be any type of attachment means currently used in the field of art for attaching docking sections to one another, tying watercraft to the docking section, attaching utilities to the docking section and the like. The present invention is free of decking or frame foundations exposed on the surface of the deck where they can corrode and degrade during exposure to a marine environment.

One of the discoveries leading to the present invention is that attachment means can be attached to a structural collar that extends continuously around the perimeter of a polymeric foam core and then the structural collar, foam, and desirably the attachment means can be covered in a protective coating. By having attachment means connected to such a structural collar tensile forces on the attachment means that would otherwise tear the attachment means from the dock can be dissipated around the periphery of the foam core. By covering the frame and foam core with a protective coating they are preserved from physical wear and environmental degradation. Moreover, the protective coating can be suitably durable to preclude a need for separate plates or decking on the surface of the foam while still providing a durable surface for walking and wear. Even more, the protective coating can bind the foam core to the structural collar and thereby help dissipate forces applied to the structural collar through the attachment means throughout the foam core.

In a first aspect, the present invention is a floating dock system comprising: (a) a polymeric foam core having opposing top and bottom major surfaces with sides extending peripherally around the foam between the major surfaces; (b) a structural collar that extends continuously around the periphery of the polymeric foam core along the sides of the polymeric foam core, the structural collar being made of material having a greater tensile strength than the polymeric foam core; (c) attachment means connected to the structural collar; and (d) a protective coating adhering to and completely covering both the polymeric foam core and the structural collar except for access ports into structural collar conduit, the protective coating being selected from a group consisting of: two-part polyurethane, one-part moisture cure polyurethane, two-part epoxy coatings, two-part polyurea coatings, two-part polyurea hybrid coating and two-part acrylic coatings; wherein the floating dock system is free of decking or plates that are independent of the structural collar between the top surface of the polymeric foam core and the protective coating.

The present invention is useful as a flotation dock or raft.

BRIEF DESCRIPTION OF THE DRAWINGS

FIG. 1 illustrates a cut-away view of a floating dock system of the present invention.

DETAILED DESCRIPTION OF THE INVENTION

Test methods refer to the most recent test method as of the priority date of this document when a date is not indicated with the test method number. References to test methods contain both a reference to the testing society and the test method number. The following test method abbreviations and identifiers apply herein: ASTM refers to American Society for Testing and Materials; EN refers to European Norm; DIN refers to Deutches Institute fur Normung; and ISO refers to International Organization for Standards.

"Multiple" means two or more. "And/or" means "and, or as an alternative". All ranges include endpoints unless otherwise indicated.

Three dimensional structures such as the foam core and floating dock system of the present invention have a length, width and thickness that are mutually perpendicular dimensions. The length is equal to the largest of the three dimensions and the thickness is equal to the smallest of the three dimensions. The width can be equal in magnitude to the length, thickness, both the length and thickness (for example, a cube) or be of a magnitude between the length and thickness.

The present invention is a floating dock system. A floating dock system is a unit structure that is buoyant in water and that serves as a dock or a component of a dock and that comprises multiple components all in the unit structure. The floating dock system can be used as an individual component or combined with additional floating dock systems of the present invention to increase the length of the resulting floating dock.

The floating dock system comprises a polymeric foam core. The type of polymeric foam for use as the polymeric foam core is not a limitation in the broadest scope of the present invention. The polymeric foam core can be, for example, polyurethane foam, expanded bead foam such as expanded polystyrene (EPS) foam or extruded polystyrene (XPS) foam. The polymeric foam core can actually be a combination of multiple foam elements (for example, multiple foam sheets, boards and/or billets) layered and optionally bonded together to form the polymeric foam core. For example, the polymeric foam core can comprise multiple polymeric foam planks that each extends the length of the polymeric foam core and that are assembled next to one another across the width or the thickness. Polymeric foam elements can be bonded together to form the polymeric foam core using water resistant adhesives such as single component moisture cure polyurethane adhesives (for example, GREAT STUFF PRO™ Wall & Floor Adhesive; GREAT STUFF PRO is a trademark of The Dow Chemical Company).

Desirably, polymeric foam forming the polymeric foam core has an open cell content of 30 percent (%) or less, preferably 20% or less, still more preferably 10% or less and even more preferably 5% or less, 2% or less, one % or less and can have an open cell content of zero %. Determine open cell content according to ASTM method D6226-05. Lower open cell contents are desirable to preclude water penetration into the foam if the polymeric foam were ever exposed to water.

Extruded polymeric foam is desirable for use as the polymeric foam core over expanded bead foam because extruded polymeric foam tends to have a greater strength than expended bead foam of similar density. Unlike extruded polymeric foam, expanded bead foam has a continuous network of bead skins that extend throughout the foam polymeric foam and encompass groups of cells. The bead skin network is a higher density film than the average foam cell wall and corresponds to the surface of the beads that expanded to form the expanded bead foam. Hydrophobic polymers are also more desirable than more hydrophilic polymers in the polymeric foam because they better resist water penetration upon exposure to water. Hence, polymeric foams such as XPS and EPS foams are more desirable than polyurethane foam.

The polymeric foam core can comprise additives including those common in polymeric foam such as colorants, pigments, ultraviolet light stabilizers and/or flame retardants. It is particularly desirable for the foam core to contain a flame retardant.

The polymeric foam core has opposing major surfaces that are essentially parallel with edges that extend peripherally around the foam between the major surfaces. One major surface is a top surface and the opposing major surface is a bottom surface. At least one major surface is a surface having a planar surface area equal to the largest planar surface area of any single surface of the polymeric foam. A planar surface area is the surface area of a surface as projected onto a plane so as to avoid inclusion of surface contours in determining surface area. The surface opposing the surface having the greatest planar surface area is also considered a "major surface". Hence, at least one of the top and bottom surfaces has the largest planar surface area of any surface of the polymeric foam core.

The sides of the polymeric foam core extend from the top to bottom surface and extend around the periphery of the polymeric foam core. The polymeric foam core can be of any shape and so can have any number of identifiable sides. A desirable shape is a square or rectangular shape with four sides, but the polymeric foam core can be circular with one continuous side or any number of sides. Desirably, the sides extend essentially perpendicular to the top and bottom surfaces but they can be any shape.

It is desirable for the top surface, preferably top and bottom surface, even more preferably all surfaces of the polymeric foam core to be planed and free of polymer skin. Planing tends to make the surface flat and exposes the cell structure which can enhance mechanical adhesion of the protective coating to the foam. If the polymeric foam core comprises multiple polymeric foam elements it is desirable for the surfaces of the polymeric foam elements to be planed to enable the polymeric foam elements to fit closely together. Alternatively, the adjoining surface of polymeric foam elements can be shaped to mating non-planar configurations (for example, tongue-and-groove configurations) to enhance and facilitate fitting of the polymeric foam elements together.

The polymeric foam core can have one or multiple groove, channel or chase (collectively refered to as "pathways") defined therein. The pathways can, for example, be milled into the polymeric foam core or defined by assembling individual foam elements together in a manner that leaves a pathway defined that extends along the resulting polymeric foam core. For generally rectangular or square polymeric foam cores, a pathway desirably extends along the length or width of a rectangular or square polymeric foam core. A polymeric foam core can have multiple pathways extending along its width, length or one or more pathway extending along the width and one or more pathway extending along the length. The pathway can be left open or be fitted with a conduit element such as tubing or channel iron through which utility components such as wires can extend or through which fluids such as water or gasoline can flow. Pathways can be any size and/or shape.

A structural collar extends continuously around the periphery of the polymeric foam core along the sides of the polymeric foam core. The structural collar can reside only along the sides of the polymeric foam core or can extend along the sides and extend onto the top surface, bottom surface, or both the top and bottom surface of the polymeric foam core. However, in order to minimize the weight of the resulting floating dock system it is desirable that the structural collar cover less than the entire top surface and less than the entire bottom surface. It is desirable that the structural collar traverse a major surface of the polymeric foam core only along the edges where the major surface and sides of the foam core meet. When the structural collar extends onto a major surface the structural collar is typically in a form of an "L-shaped" piece that resides on an edge of the polymeric foam core with one leg of the "L" extending onto a major surface and another leg of the "L" extending onto the side of the polymeric foam core. Examples of "L-shaped" pieces include what is commonly known as "angle iron" but is not limited to an iron composition.

The structural collar can be of essentially any form including a band, cable, a frame of L-shaped members, hollow conduit or a combination of two or more different forms. Examples of combinations of different forms include a band or cable attached to a hollow conduit or an L-shaped member with a conduit attached to or serving as a leg of the "L" for at least a portion of the collar. Hollow conduit is desirable for at least a portion of the structural collar because it can house electrical and even plumbing components that extend along the floating dock system.

The structural collar can be made of any material provided the material has a greater tensile strength than the polymeric foam core. Desirably, the structural collar is made of a material selected from metal (for example, aluminum, steel, galvanized steel, stainless steel, iron and copper), polymer resin, reinforced polymer resin (for example, fiberglass-reinforced pull-truded polymer) or any combination thereof.

It is desirable to adhesively attach the structural collar to the polymeric foam core. For example, it is desirable to include an adhesive between the structural collar and the polymeric foam. Adhesively attaching the structural collar to the polymeric reduces the likelihood that the collar can move apart from the foam and increases the connectivity of the collar with the foam to enhance distribution of forces from the structural collar to the foam. It is desirable that the adhesive between the structural collar and the polymeric foam core have a greater tensile strength and bond to the structural collar and polymeric foam core with a greater tensile strength than the polymeric foam core possess within itself. Examples of suitable adhesives for attaching the structural collar to the polymeric foam core include water resistant adhesives such as single component moisture cure polyurethane adhesives (for example, GREAT STUFF PRO™ Wall & Floor Adhesive; GREAT STUFF PRO is a trademark of The Dow Chemical Company).

An attachment means is connected to the structural collar and multiple attachment means can be connect to the structural collar. Attachment means are fixtures suitable for attaching objects. Desirable attachment means include mating attachment means (for example, male and female attachment means) that connect to one another. The floating dock system can comprise male attachment means on one side and female attachment means on an opposing side so that multiple floating dock systems can be connected to one another in series. Similarly, a floating dock system can have an attachment means and a stationary dock, platform or land-based structure can have a mating attachment means that enables the floating dock system to attach to the stationary dock, platform or land-based structure. Other attachment means include cleat, mooring tie-downs, handles, as well as clamps and/or brackets for pipes, tubes or other conduits, railings, or supports.

Desirably, the attachment means are integral with the structural collar so as to be a single structure (for example, welded to or integrally formed with structural collar) rather than exist as separable pieces that can be reversibly connect and disconnected at will (for example, pieces bolted to the structural collar). By integrating the attachment means with the structural collar fewer components are necessary in the floating dock system, which results in simpler and easier manufacturing as well as lighter weight than systems requiring bolts and the like to attach pieces together. Moreover, attachment means that are integrated with the structural collar remain connected with greater stability than those bolted to a dock since bolts can come loose over time and under dynamic forces of thermal expansion and contraction as well as wear. Stability in the connection of the attachment means to the structural collar in the present invention is particularly valuable because a protective coating completely covers the polymeric foam core and the structural collar, and desirably further covers the attachment means. As a result, the point at which an attachment means connects to the structural collar is not readily accessible without removing the protective coating so attachment means are desirably firmly and stably attached to the structural collar.

The design of the present floating dock system benefits from having the attachment means connected to the structural collar. Upon application of forces to the attachment means, such as when a moored boat or adjoining floating dock system attempts to pull away from the floating dock system comprising the attachment means, the forces are distributed around the polymeric foam core by means of the structural collar. Such a distribution of the force reduces the likelihood that the attachment means will tear away from the floating dock system despite the light weight properties of the dock. This particular design precludes the need to build up a great deal of mass and strength directly at the attachment means to resist applied forces from tearing off the attachment means and allows lighter weight structures which can withstand great forces on the attachment means.

The protective coating adheres to and completely covers both the polymeric foam core and the structural collar, optionally except for access ports that may be defined in a structural collar conduit. The protective coating can, but does not necessarily completely cover the attachment means on the floating dock system. "Completely covering" means that any of the components being completely covered and that would be visible to an unaided eye without the coating are precluded from being visible with an unaided eye by the coating. The protective coating provides a barrier around the polymeric foam that protects it from damage by physical wear, environmental exposure, or other damage resulting from being exposed.

The protective collar does not necessary cover access ports into conduit of the structural collar. Access ports provide an entrance or access from outside the floating dock system to inside a structural collar conduit. Such conduit can be useful for transporting electrical or plumbing and may require access from outside the floating dock system to service, connect or otherwise access inside the conduit. Permanently sealing over access ports in conduit with the protective coating by completely covering the access ports is an option under the present invention. Alternatively, access ports in structural collar conduit can be sealed with a cap or plug. Desirably, the cap or plug is able to be reversibly removed and replaced to allow access into the conduit as needed. Caps or plugs are desirably selected from plastic or rubber compositions but can be other materials such as metal. Access ports can be left open if desired or can be connected to an external conduit (such as an electrical conduit or plumbing pipe) that extends from the structural collar. For example, an external electrical conduit can connect to an access port through which electrical wires traveling through the structural collar conduit can travel to an electrical outlet attached to the external electrical conduit.

The protective coating is a polymeric based material from a group of thermosetting resins consisting of thermosetting two-part polyurethane, thermosetting one-part moisture cure polyurethane, thermosetting two-part epoxy coatings, thermosetting two-part polyurea coatings, thermosetting two-part polyurea hybrid coating andthermosetting two-part acrylic coatings. These thermosetting resins are solvent-free, which means that when they are applied to a thermoplastic foam there is no solvent that will dissolve or degrade the thermoplastic foam. The thermosetting resins cure to form a cross-linked protective polymeric coating that is more durable than thermoplastic coatings. For example, the protective coating of the present invention offers greater solvent resistance than a thermoplastic coating—a feature that is important in case gasoline being transported to a docked boat spills onto the protective coating. Two-part aliphatic polyurea hybrid coatings are particularly desirable due to their physical and mechanical properties, ultraviolet light stability, anti-static and/or static dissipative (ESD) properties and speed of application (especially spray applied version of the coating). Examples of particularly desirable protective coatings are two-component aliphatic polyurea hybrid spray coatings such as HYPERKOTE™ 420 (HYPERKOTE is a trademark of The Dow Chemical Company).

The protective coating is distinct from a shell that merely houses a polymeric foam core. The protective coating directly contacts and adheres to both the polymeric foam core and the structural collar. As a result, the protective coating helps bind the structural collar and polymeric foam core together thereby reinforcing and stabilizing the structural integrity of the floating dock system. This is a desirable benefit of adhering to both the polymeric foam core and structural collar that helps dissipate forces applied to the structural collar (for example, by boats or other floating dock systems attached to the structural collar through the attachment means) around the entire foam core. Moreover, it is desirable that there exist minimal void space between the protective coating and the foam core because such void space can be susceptible to holding water if the coating becomes punctured, which can result in diminished buoyancy and freeze-thaw damage. Hence, it is desirable for the floating dock system to have an absence of any singular void space greater than 50 milliliters (mL), preferably 25 mL or greater, still more preferably ten mL or greater and even more preferably five milliliters or greater in volume between the protective coating and the polymeric foam core other than conduit void space that is part of the structural collar.

The protective coating can be textured with traction enhancing features to improve traction when walking on the floating dock system. Texturing can include embossing, impressing or molding a contour into the protective coating surface. Texturing can also, or alternatively, include incorporating an additive that increases traction, a "traction enhancing component" (for example, silica, sand, coated polymer quartz, aluminum oxide, micro beads or other granular material) into the coating on one or more surface or throughout the entire coating.

The protective coating can also include additives that serve purposes other than or in addition to increasing traction. The protective coating can possess inherent ultraviolet resistant character and/or include ultraviolet light stabilizers/blockers, colorants, pigments, and conductive fillers to dissipate static charge (for example, carbon powder, carbon fiber, metallic powder and/or metallic fiber).

The floating dock system of the present invention can be free of decking or plates apart from the structural collar extending over the top surface of the polymeric foam core either between the polymeric foam core and protective coating or over the protective coating. The protective coating itself is sufficiently durable and capable of withstanding wear that such decking and/or plates are unnecessary.

In one desirably embodiment the floating dock system of the present invention comprises a structural collar with an L-shaped bracket (for example, "angle iron" of any of the aforementioned structural collar compositions) running along the edges of the top surface and sides of the polymeric foam core and extending along the sides of the polymeric foam core and partially, but not entirely, over the top surface of the foam core; an adhesive between the structural collar and the polymeric foam core; and attachment means in the form of male attachment means on one side of the polymeric foam core and female attachment means that connect to the male attachment means on an opposing side of the polymeric foam core.

EXAMPLE

Prepare a polymeric foam core using seven STYROFOAM™ brand buoyancy billets (STYROFOAM is a trademark of The Dow Chemical Company), each having a thickness of 25.4 centimeters (ten inches), width of 61 centimeters (24 inches) and a length of 2.7 meters (nine feet). Each STYROFOAM brand buoyancy billet had each surface planed flat and free of polymer skin. Glue the billets together by applying beads of GREAT STUFF PRO™ Wall and Floor adhesive (GREAT STRUFF PRO is a trademark of The Dow Chemical Company) extending the 2.7 meter dimension in a straight line every 15.24 centimeters (6 inches) along the 61 centimeter dimension on a 61 centimeter by 2.7 meter face of a billet and then pressing that 61 cm by 2.7 m face of the billet against another 61 cm by 2.7 m face of another billet. Repeat until all of the billets are glued together with adhesive between adjoining 61 cm by 2.7 meter faces to form a polymeric foam core having a thickness of 61 centimeters (24 inches), width of approximately 178 centimeters (70 inches) and a length of 2.7 meters (nine feet).

Fabricate a structural collar by welding angle-iron having 5.08 centimeter (two-inch) legs and a 9.5 millimeter (3/8-inch) thickness so as to form a unitary rectangular frame that extends around the 2.7 meter by 178 centimeter surface (top surface) of the foam core with one of the legs extending onto the top surface and the other leg extending down the sides in the thickness dimension of the foam core.

As an alternative embodiment 9.5 millimeter (3/8-inch) channel iron can be used in place of one or more length of angle iron to form the structural collar and then the polymeric foam core can be milled out along the edge on which the channel iron resides so as to receive the channel iron. Channel iron is desirable to house pipe for feeding electrical, gas and/or liquid along the dock.

Weld attachment means onto the structural collar. For the case of this example, weld two single-T female connection brackets (for example, article H-SF from Merco Marine) spaced a specific distance apart on the 178 centimeter (70 inch) length of the collar and two single-T male connection brackets (for example, article H-SM from Merco Marine) spaced the same specific distance apart on the opposing 178 centimeter (70 inch) length of the collar. The male and female single-T connection brackets are positioned so that opposing ends of similar docks can mate and be connected using the single-T brackets. Weld three-inch pipe holders (for example, article P-3 from Merco Marine) at various location around the collar. Also weld galvanized steel cleats (such as article C-8 from Merco Marine) along the structural collar.

Glue the structural collar to the foam core by running a bead of GREAT STUFF PRO™ Wall and Floor adhesive along the each leg and in the corners of the structural collar and then setting the structural collar onto the polymeric foam core such that the adhesive is between the structural collar and the polymeric foam core. When using channel iron, run a bead along the edges of the channel iron that contact the polymeric foam core when placed into position. Allow the adhesive to cure and affix the structural collar to the polymeric foam core.

To form a protective coating spray a two-component aliphatic polyurea hybrid spray coating (for example, HYPERKOTE™ 420, HYPERKOTE is a trademark of The Dow Chemical Company) so as to completely cover the polymeric foam core, structural collar and attachment means to a thickness of approximately 100 mils. A traction enhancing component or other additive can be incorporated into the coating by blending into the coating prior to applying to the foam core or by simultaneously mixing with the coating while applying to the foam core.

The resulting structure is a floating dock system of the present invention. FIG. 1 illustrates the floating dock system as 10 with polymeric foam core 20 comprising STYROFOAM™ buoyancy billets 25, structural collar 30, female single-T connection brackets 42, male single-T connection brackets 44, pipe holder 46, galvanized steel cleats 48 and protective coating 50. FIG. 1 illustrates protective coating 50 cut-away so as to only cover a portion of the floating dock system in order to reveal the various components.

What is claimed is:

1. A floating dock system comprising:

a. a polymeric foam core having opposing top and bottom major surfaces with sides extending peripherally around the foam between the major surfaces;

b. a structural collar that extends continuously around the periphery of the polymeric foam core along the sides of the polymeric foam core, the structural collar being made of material having a greater tensile strength than the polymeric foam core;

c. attachment means connected to the structural collar; and d. a protective coating adhering to and completely covering both the polymeric foam core and the structural collar except for access ports into structural collar conduit, the protective coating being selected from a group of thermosetting resins consisting of: two-part polyurethane, one-part moisture cure polyurethane, two-part epoxy coatings, two-part polyurea coatings, two-part polyurea hybrid coating and two-part acrylic coatings;

wherein the floating dock system is free of decking or plates that are independent of the structural collar between the top surface of the polymeric foam core and the protective coating, and further characterized by the attachment means being integral with the structural collar.

2. The floating dock system of claim 1, further characterized by the structural collar extending partially, but not entirely, over the top surface and sides of the polymeric foam core around the periphery of the polymeric foam core top surface.

3. The floating dock system of claim 1, further characterized by an adhesive between the structural collar and the polymeric foam core.

4. The floating dock system of claim 1, further characterized by the structural collar being made of material selected from metal and fiber reinforced polymer compositions.

5. The floating dock system of claim 1, further characterized by the protective coating completely covering the attachment means.

6. The floating dock system of claim 1, further characterized by the protective coating being textured with traction enhancing features.

7. The floating dock system of claim 1, further characterized by there being an absence of and singular void space greater than five milliliters between the protective coating and the polymeric foam core other than conduit void space that is part of the structural collar.

8. The floating dock system of claim 1, further characterized by the polymeric foam core having pathways defined therein.

9. The floating dock system of claim 1, further characterized by:

i. the structural collar with an L-shaped bracket running along the edge of the top surface and sides of the polymeric foam core and extending along the sides of the polymeric foam core and partially, but not entirely, over the top surface of the foam core;

ii. by the presence of an adhesive between the structural collar and the polymeric foam core; and iii. attachment means in the form of male attachment means on one side of the polymeric foam core and female attachment means that connect to the male attachment means on an opposing side of the polymeric foam core.

* * * * *